United States Patent [19]

Peck

[11] Patent Number: 4,620,523

[45] Date of Patent: Nov. 4, 1986

[54] ADJUSTABLE GRIP AND TRIGGER BOW STRING RELEASE

[75] Inventor: Paul L. Peck, Fond du Lac, Wis.

[73] Assignee: Archery Designs, Inc., North Fond du Lac, Wis.

[21] Appl. No.: 735,049

[22] Filed: May 17, 1985

[51] Int. Cl.[4] ..... F41C 19/00

[52] U.S. Cl. ..... 124/35 A

[58] Field of Search ..... 124/23 R, 24 R, 35 A

[56] References Cited

U.S. PATENT DOCUMENTS

| | | | |
|---|---|---|---|
| 4,257,386 | 3/1981 | Gazzara | 124/35 A |
| 4,476,845 | 10/1984 | Rickard | 124/35 A |
| 4,485,798 | 12/1984 | Hamm | 124/35 A |
| 4,527,536 | 7/1985 | Smith | 124/35 A |

*Primary Examiner*—Richard C. Pinkham
*Assistant Examiner*—Benjamin Layno
*Attorney, Agent, or Firm*—Bayard H. Michael

[57] ABSTRACT

The bow string release has a sear pivotally mounted in a cylindrical body and includes a string retaining finger which projects across the string receiving notch when the sear is engaged by a pull pin biased to the sear engaging position. The pull pin is slidable in a guide sleeve assembly extending through the end wall of the body through a handle which carries a trigger through which the pull pin passes. The ends of the sleeve assembly are enlarged to capture the body and handle. The body is rotatable relative to the handle and the pull pin. When the trigger is actuated it rocks about a fulcrum (its point of engagement with a washer or with the handle) to push an enlarged head on the end of the pin to pull the pin to release the sear. In one embodiment, an adjusting screw moves the enlarged head relative to the thrust washer to partly pull the pin to adjust the trigger travel necessary to release the bow string. In another embodiment the trigger has an adjusting screw which, in effect, partly pulls the trigger to adjust the travel. The trigger is mounted in the cylindrical body of the handle. A grip is rotatable on the cylindrical body. The trigger (and the cylindrical body) is rotatable relative to the grip and/or the string notch and the grip is rotatable relative to the string notch (and/or the trigger).

10 Claims, 4 Drawing Figures

ADJUSTABLE GRIP AND TRIGGER BOW STRING RELEASE

BACKGROUND OF THE INVENTION

Bow string releases have grown in popularity for target shooting and for hunting. A good release provides uniform "let-off" which increases accuracy. A release should provide for adjustment of the trigger stroke and should allow adjustment of the relative angular relationship between the handle and the bow string. U.S. Pat. No. 4,485,798 provides for these adjustments but the adjustments are interdependent in that adjusting one affects the other. My application Ser. No. 716,627 provides a release in which the adjustments are independent of one another.

The object of this invention is to provide a release having such independent adjustment of the stroke and angular relationship while also providing adjustment of the rotational position of the trigger relative to the handle which is rotatable relative to the string notch, a degree of customizing not available in the art.

SUMMARY OF THE INVENTION

This invention provides a bow string in which the body has a string receiving notch in one end and an axial hole through the other end. A sear is pivoted in the body adjacent the notch and has string retaining fingers operative to retain a bow string in the notch when the sear is in its operative position. The release includes a handle having an axial hole therethrough. A sleeve assembly extends through the axial holes in the body and handle and an enlargement on each end of the sleeve assembly captures the handle and the body on the assembly. The body is rotatable relative to the handle. A pull pin assembly is slidably mounted in the sleeve assembly for movement between a first position and a retracted position. The pin assembly engages the sear in the first position to retain the sear in operative position and releases the sear upon movement to retracted position. A spring biases the pin assembly to the first position. A trigger is carried by the handle and is operative to move the pin assembly to the retracted position. The handle and body are rotatable relative to each other and relative to the pin assembly. A grip is connected to the handle by means allowing adjustment of the grip relative to the handle.

Another feature is that the trigger stroke can be adjusted without affecting the adjustment of the handle relative to the body. In one version the adjustment adjusts the trigger position relative to the handle while another version makes the adjustment at a point between the trigger and the pull pin. Both versions end up adjusting the extent to which the pin overlaps the sear.

BRIEF DESCRIPTION OF THE DRAWINGS

In FIG. 2, the position of the handle relative to the bow string notch is offset about 90° from the position in which most users would use the release. This orientation permits showing all the parts in one view. It will be understood that the barrel and hence the pivoted sear, etc. can be rotated 90° with ease.

DETAILED DESCRIPTION OF THE DRAWINGS

Figure 1:
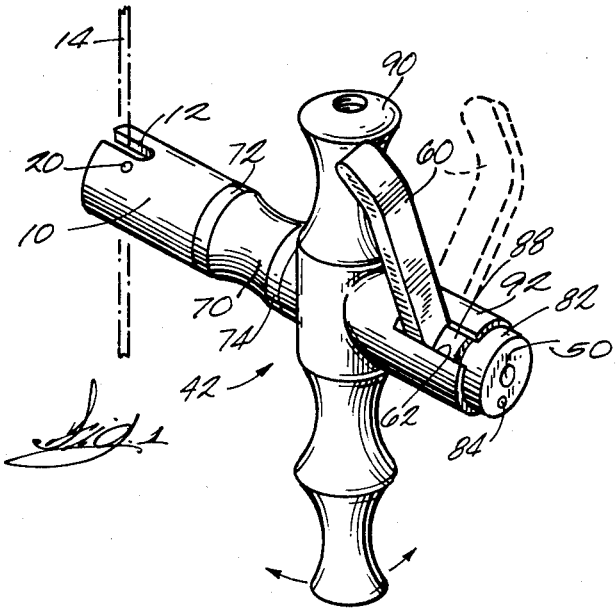
FIG. 1 is a perspective view of one embodiment and illustrates how the trigger can be adjusted relative to the handle which is rotatable relative to the bow string notch.

The release shown has a body or barrel 10 having diametrically opposed slots 12 to receive bow string 14 for retention by the retaining finger 16 projecting at right angles from the sear 18 pivoted in the barrel on roll pin 20 just under the slot 22 which permits the sear freedom of movement relative to the body. The sear is also provided with a projecting reset finger 24 against which the bow string can be pushed to move the sear clockwise to permit the round end of the spring loaded round plunger or pull pin 26 to slide under the left end of the sear 18 to retain it in its cocked position. As the release is moved to draw the bow string, the bow string will act against the retaining finger 16 trying to move the pin in a counterclockwise direction, but the sear is prevented from such movement by its engagement with the pull pin 26.

The pull pin 26 is guided in sleeve 28 which is mounted in a hole 30 in the barrel 10 with a suitable plastic or brass thrust washer 32 between the inturned end wall 36 of the barrel 10 and the enlarged cup-like head 34 of the sleeve 28 to couple the sleeve 28 to the barrel 10. Thus, the barrel and the sleeve 28 cannot be axially separated (in the pull direction). A spring 38 compressed between the cup-like head 34 of the sleeve and the C-ring 40 mounted in a groove in the pull pin biases the pull pin to the right into operative engagement with the sear 18. The degree of movement of the pull pin to the right is limited as hereafter explained.

The left end of the pull pin 26 has a reduced diameter portion 50 which passes through washers 78, 80, the hole in trigger 60, washer 88 and the hole in the head 82 and is provided with a C-ring 58 capturing the head 56 so that if the head 56 moves to the left, the pull pin 50/26 will be pulled to the left and moved out from under the end of the sear 18 causing the bow string to be released.

Pull pin 50/26 passes through the aperture in trigger 60 to capture the trigger on the pull pin between the washers 80, 88. The trigger is mounted in the slot 62 in the cylinder 92 which is part of the handle 42 mounted on sleeve 28. The handle 42 also includes grip 90. If the trigger is moved to the right, it will pivot about the corner 64 at the reduced diameter portion of washer 80 and this will move the portion 66 of the trigger to the left causing the pull pin to be moved to the left to release the sear. It will be apparent that the movement of the pull pin to the right under the influence of the compressed spring 38 can be limited by adjusting the screw 84 to turn it inwardly against washer 88 and pull the head 82 and pin 26 to the left. In this way, the trigger can be "haired" to the user's desire.

The handle 42 and trigger 60 can be rotated about the sleeve 28 to position the handle relative to the bow string notch in the barrel at the most comfortable position. This is a free rotation. Spool 70 is mounted on sleeve 28 between washers 72, 74 in the axial position likely to be engaged by the user's fingers when pulling grip 90. Since the spool 70 is freely rotatable on the spool 28, any frictional engagement between the user's fingers and the barrel is obviated.

Trigger 60 can be adjusted relative to the grip 90 which is rotatably mounted on the cylinder 92 which is in turn rotatably mounted on the sleeve 28. Thus, the grip 90 and cylinder 92 can be rotated relative to each other and relative to the body 10. The short portion of the grip 90 is provided with a brass or plastic key 94 which can be moved in the threaded bore as dictated by the adjusting screw 96. When the adjusting screw is turned in just partly, the nose 98 of the key 94 will engage groove 100 in the cylinder 92. In this position the grip can rotate 360° relative to the cylinder 92 but cannot move axially. If now the adjusting screw 96 is turned in more, the nose 98 of the key 94 will jam into the bottom of the groove 100 and will lock the grip relative to the cylinder. Grip 90 can be freely rotated relative to the cylinder 92 and relative to the bow string receiving notch in the barrel 10.

Trigger 60, being mounted in the cylinder can be rotated relative to the bow string notch and to the grip and can be.offset, for example, at an angle relative to the grip as shown in solid or dashed lines. Grip 90 can be rotated relative to the bow string so the user's hand can be at the most comfortable position relative to the string and the trigger can be at the most comfortable angle relative to the hand. No bow string release has provided such a choice before.

Stop 102 prevents the sear from spinning around its pivot when released. The stop is a Nylon screw threaded through the barrel wall to project into the cavity. It can be easily replaced when worn out by the battering it will receive.

It may be noted the pressure required to actuate the trigger is determined by the diameter of the inner corner 64 of the stepped washer 80 since this determines the lever ratio [the distance between 64 and the (thumb) end of the trigger compared to the pivot corner 64 and the point of contact of the short end of the trigger with washer 88]. The "length" of the "short end" of the trigger can also be shortened to decrease the actuation force.

Figure 3:
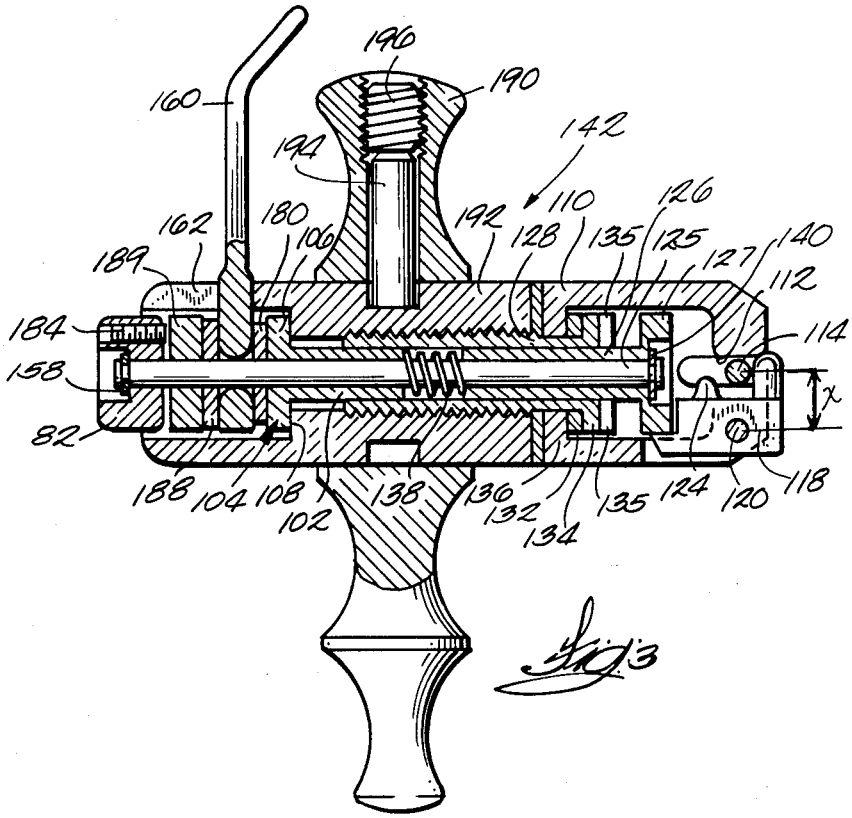
FIG. 3 shows the preferred embodiment which requires less trigger force and can be made at lower cost.

The cylindrical portion 192 of handle 142 in the preferred embodiment of FIG. 3 is internally threaded to enable the threaded tube or sleeve 128 to be threaded into the cylinder 92 so the enlarged head 134 of the tube 128 can capture the thrust washer 132 between the head 134 and the inturned end wall 136 of the barrel 110. The barrel should be freely rotatable without wobble. The tube head 134 is provided with slots 135 so a spanner can be used to turn the tube 128 into the cylinder. Then the sleeve portion 102 of the spring seat 104 is pressed into the bore of tube 128 until head 106 abuts the shoulder 108 inside cylinder 192. This press fit axially fixes the cylinder on tube 128 for rotation relative to sleeve 102.

The pull pin assembly includes pin 125 and sleeve 126 which has an enlarged head 127 operative to engage sear 118. Retainer 140 prevents movement of the sleeve 126 beyond the right end of the pin 125. Spring 138 is compressed between seat 104 and sleeve 126 to bias the pull pin assembly to the right. Pin 125 passes through washer 180, the aperture in trigger 160, washer 188, spacer 189 and head 182 for retention by ring 158. Adjusting screw 184 will adjust the overlap of head 134 on sear 118. Therefore, this adjusts the stroke of the trigger 160 necessary to release the sear.

The center of pivot pin 120 for the sear is a distance X from the center line of the release (or notch 112). The pull pin head 134 preferably engages the sear at a distance greater than X. When so designed, the force required to actuate the trigger is substantially reduced compared to the FIG. 2 design. The pivot pin 120 should be in the transverse plane including the bow string 114 so the pivot is close to the string. This maximizes the force considerations.

Figure 4:
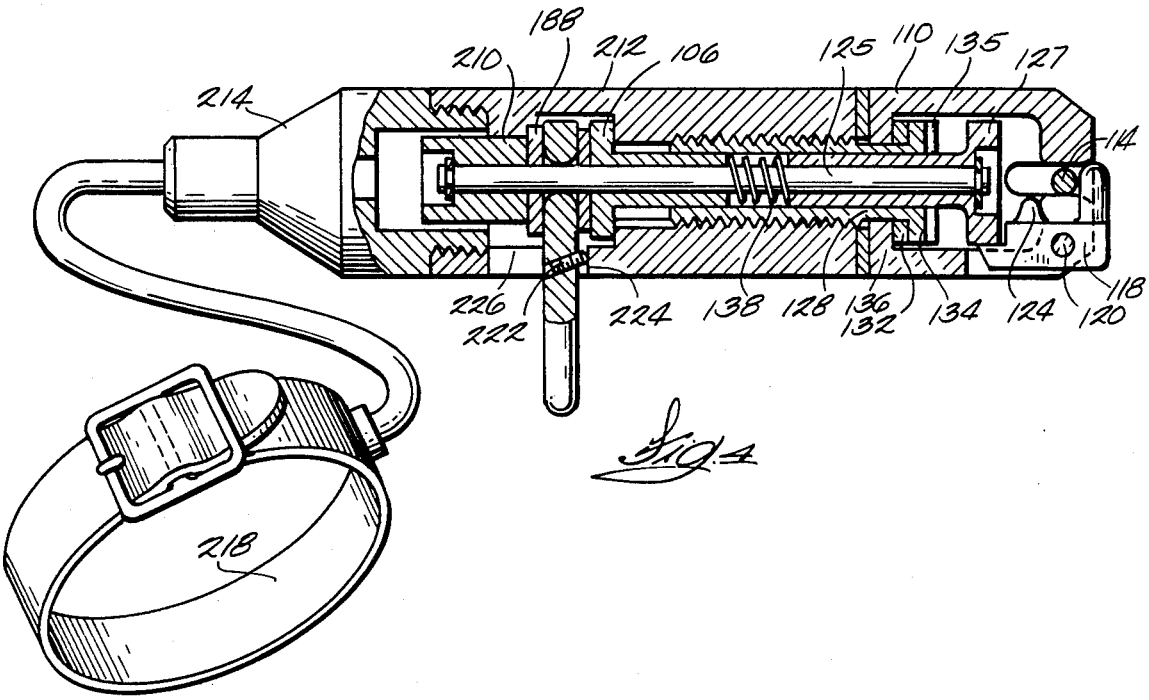
FIG. 4 is another embodiment which retains many low cost features of FIG. 3 but has a different adjustment for the trigger stroke.

The release shown in FIG. 3 can be adapted to a "concho" type release or to a wrist band type release with the construction shown in FIG. 4. This arrangement is the same as FIG. 3 except that the left end of the pull pin assembly terminates in annulus 210 and the cylinder 212 is internally threaded to receive cap 214. The strap or lanyard 216 from the wrist strap 218 is knotted or otherwise enlarged inside cap 214 to provide a simple connection. The trigger stroke can't be adjusted as in FIGS. 1-3. Therefore, trigger 260 is provided with adjusting screw 222 bearing against the front wall 224 of slot 226 in cylinder 212. Turning screw 222 to project forwardly from the trigger 260 against the wall will cause the washer and annulus 210 to move left to pull pin 125 and sleeve 126 left to decrease the stroke required for release. Trigger 260 can be pulled (left) or pushed (right) to release.

Figure 2:
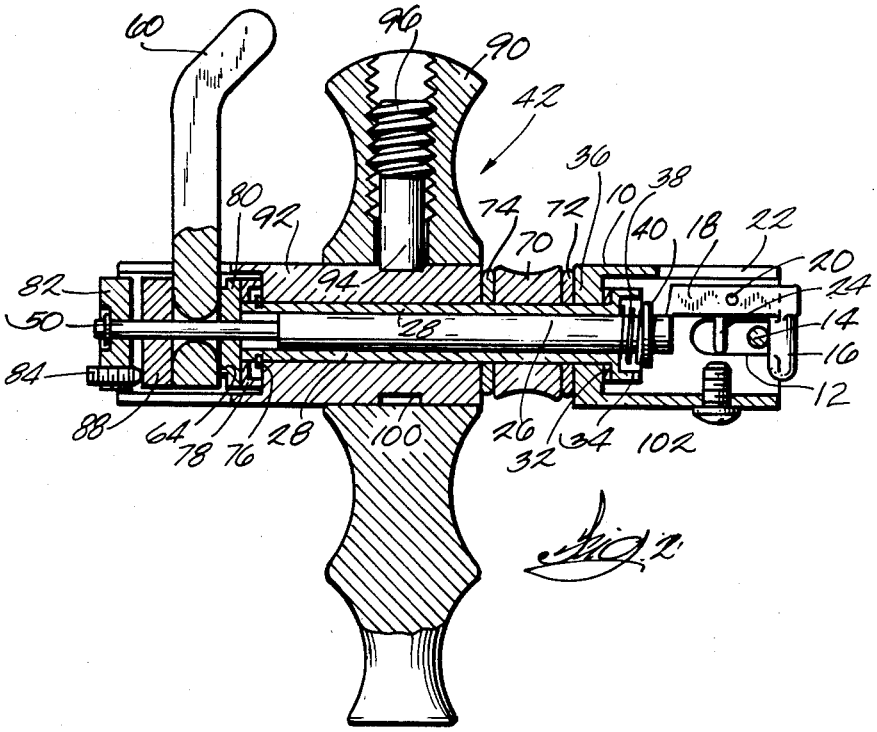
FIG. 2 is a vertical section through the embodiment of FIG. 1.

It will be noted the embodiments of FIGS. 3 and 4 have a simple bump 124 which has the same function as the reset finger 24 in FIG. 2. The "bump" is very smooth working and is easier to make.

It will be noted in FIG. 2 the sleeve 28 extends through body 10 and handle 42 on their common axis. An enlargement on each end of the sleeve (head 34 and retaining ring 76) capture the handle and body on the sleeve while allowing both to rotate relative to each other and relative to the pull pin 26.

In FIG. 3 the sleeve extending through the body 110 and the handle 142 is made up from sleeve 128 threaded into the handle and sleeve 102 pressed into the end of sleeve 128 to journal the pull pin 125/126. The head 134 on sleeve 128 and head 106 on the spring seat 104 (sleeve 102) capture the handle and body in the sleeve means 128/102. The FIG. 3 construction is easier to make and assemble. It is easier to press fit the spring seat than it is to mount the retaining ring 76 (in FIG. 2). The Fig. 3 construction can incorporate a spool (like spool 70 in FIG. 2) and the length of the pull pin can be modified accordingly.

I claim:

1. A bow string release comprising, a body having a string receiving notch in one end of said body and an axial hole through the other end of said body, a sear pivoted in the body adjacent said notch and having string retaining means operative to retain a bow string in said notch when said sear is in its operative position, handle means having a cylindrical portion with an axial hole therethrough, sleeve means extending through said axial holes, an enlargement on each end of said sleeve means capturing said handle means and said body, pull pin means slidably mounted in said sleeve means for movement between a first position and a retracted position, said pin means engaging said sear in said first position to retain said sear in said operative position and releasing said sear upon movement to said retracted position, spring means biasing said pin means to said first position, a trigger carried by said handle means and operative to move said pin means to said retracted position, said handle means and said body being rotatable relative to each other and relative to said pin means and grip means connected to said cylindrical portion of said handle means adjusting means allowing adjustment of said grip means relative to said cylindrical portion.

2. A bow string release according to claim 1 which said trigger means is mounted for rotation with said cylindrical portion.

3. A bow string release according to claim 1 in which said pull pin means is rotatable with respect to said sear and said sleeve means.

4. A bow string release according to claim 3 including a spool rotatably mounted on said sleeve means between said handle means and said body.

5. A bow string release according to claim 1 in which said pull pin means obstructs and overlaps said sear when in said first position, the distance by which said pin means overlaps said sear determining the trigger travel necessary to release said sear, and including means for adjusting said distance.

6. A bow string release according to claim 5 in which said adjusting means comprises means acting to limit movement of said pull pin means in the direction of said first position.

7. A bow string release according to claim 6 in which said trigger rocks about a fulcrum to actuate said pin means, and said adjusting means varies the position of said pin means relative to said trigger means.

8. A bow string release according to claim 6 in which said trigger rocks about a fulcrum to actuate said pin means, and said adjusting means varies the location of said fulcrum to move said trigger through some of its stroke.

9. A bow string release according to claim 1 in which said trigger is actuated in a plane including the axis of said axial holes, said trigger and said handle being rotatable relative to said body.

10. A bow string release according to claim 9 in which said grip means is mounted on said handle for rotation about the axis of said axial holes to optimize for the user the location of said grip means relative to said notch and to optimize the location of said trigger relative to said grip means.

* * * * *